US005720823A

United States Patent [19]

Carlson et al.

[11] Patent Number: 5,720,823

[45] Date of Patent: Feb. 24, 1998

[54] COMPOSITION AND PROCESS FOR DESMUTTING AND DEOXIDIZING WITHOUT SMUTTING

[75] Inventors: Lawrence R. Carlson, Waterford; Philip M. Johnson, Southfield, both of Mich.

[73] Assignee: Henkel Corporation, Plymouth Meeting, Pa.

[21] Appl. No.: 359,661

[22] Filed: Dec. 20, 1994

Related U.S. Application Data

[63] Continuation-in-part of Ser. No. 88,998, Jul. 9, 1993, Pat. No. 5,393,447.

[51] Int. Cl.[6] ..... C23F 3/06; C23F 3/03; C23G 1/10; C23G 1/12

[52] U.S. Cl. ..... 134/3; 134/41; 252/79.1; 252/79.2; 252/79.3; 252/79.4; 252/186.1; 252/186.21; 252/188.1; 252/188.2

[58] Field of Search ..... 252/101, 89.1, 252/79.2, 79.3, 79.4, 186.1, 188.1, 188.2, 186.21, 79.1; 134/3, 27, 28, 41

[56] References Cited

U.S. PATENT DOCUMENTS

| | | | |
|---|---|---|---|
| 2,441,300 | 5/1948 | Vande Bunte | 41/42 |
| 3,140,203 | 7/1964 | Grunwald | 134/3 |
| 3,275,562 | 9/1966 | Smith | 352/147 |
| 3,510,430 | 5/1970 | Mickelson et al. | 252/79.1 |
| 3,728,188 | 4/1973 | Yarrington | 156/22 |
| 4,883,541 | 11/1989 | Tadros | 134/3 |
| 4,886,616 | 12/1989 | Yamasoe et al. | 252/142 |
| 5,393,447 | 2/1995 | Carlson et al. | 252/101 |

FOREIGN PATENT DOCUMENTS

| | | |
|---|---|---|
| B 23652 | 1/1989 | Australia . |
| 0196668 | 10/1986 | European Pat. Off. . |
| 48-42537 | 12/1973 | Japan . |
| 413227 | 5/1974 | U.S.S.R. . |

OTHER PUBLICATIONS

CRC Handbook of Chemistry and Physics 63rd ed. (1982–1983) p. B–121.

JP 0322659A Oct. 1991 As Abstracted by Chemical Abstract 91–336533.

*Primary Examiner*—Sharon Gibson
*Assistant Examiner*—Valerie Fee
*Attorney, Agent, or Firm*—Wayne C. Jaeschke; Norvell E. Wisdom, Jr.; Wayne C. Jaeschke, Jr.

[57] ABSTRACT

A chromium and ferricyanide free aqueous deoxidizer/desmutter for aluminum and magnesium alloys contains nitric acid, ferric ions, and molybdate and/or condensed molybdate anions and preferably also sulfate and fluoride.

20 Claims, No Drawings

COMPOSITION AND PROCESS FOR DESMUTTING AND DEOXIDIZING WITHOUT SMUTTING

CROSS-REFERENCE TO RELATED APPLICATION

This application is a continuation-in-part of application Ser. No. 08/088,998 filed Jul. 9, 1993, now U.S. Pat. No. 5,393,447.

BACKGROUND OF THE INVENTION

1. Field of the Invention

This invention relates to compositions and processes for desmutting metal surfaces, particularly the surfaces of aluminum and magnesium and their alloys that contain at least 45% by weight of aluminum or magnesium, more particularly aluminum alloys containing sufficient copper to form smut on their surfaces easily when dissolving. The compositions and processes are also useful for deoxidizing unsmutted surfaces and achieve deoxidizing without forming smut on the surfaces or otherwise staining them. ("Deoxidizing" is to be understood herein as the removal from the surface of metals of oxide films and other adherent inorganic materials that would reduce adhesion to subsequently desired protective coatings such as conversion coatings and/or paints and the like. With most deoxidizing agents, there is a perceptible but controlled dissolution of the underlying metal while the deoxidizing agent is in contact with it. In contrast, "desmutting" is to be understood herein as the removal, without significant attack on the underlying metal, of powdery and usually darkly colored residues produced on a treated metal surface by some prior cleaning, etching, and/or deoxidizing treatment.)

2. Statement of Related Art

Since the development of copper containing aluminum aerospace alloys several decades ago, the conventional deoxidizing compositions have normally included concentrated nitric and/or sulfuric acid and chromates, with fluorides, ferric ions, oxidizers such as persulfate and peroxide, and ferricyanide all serving as frequently used optional ingredients. In recent years there has been environmentally driven incentive to avoid chromates and ferricyanides, but no fully satisfactory deoxidizer free from these materials is believed to have been developed.

DESCRIPTION OF THE INVENTION

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole, and any counterions thus implicitly specified should preferably be selected from among other constituents explicitly specified in ionic form, to the extent possible; otherwise such counterions may be freely selected, except for avoiding counterions that act adversely to the objects of the invention; the term "mole" means "gram mole", and "mole" and its variations may be applied herein to ionic or any other chemical species with defined numbers and types of atoms, as well as to chemical substances with well defined conventional molecules.

SUMMARY OF THE INVENTION

It has been found that molybdate ions and ferric ions have a favorable synergistic effect in nitric acid based desmutting compositions, permitting the elimination of both chromates and ferricyanides while producing excellent results in desmutting aluminum and magnesium and their alloys, including copper containing alloys. The same compositions can be used if desired as deoxidizers for metal surfaces that have oxide films that are unwanted, and can accomplish deoxidizing effectively without forming smut on the deoxidized surfaces or otherwise staining the surfaces, particularly if not allowed to dry on the surface before rinsing.

Accordingly, one embodiment of the invention is an aqueous composition that comprises, preferably consists essentially of, or more preferably consists of, water and:

(A) nitric acid;

(B) ferric ions;

(C) molybdate and/or condensed molybdate anions; and, optionally, one or more of the following components:

(D) persulfate (i.e., $S_2O_8^{-2}$, also called "peroxydisulfate") anions;

(E) fluorine containing anions;

(F) sulfuric acid and/or sulfate ions;

(G) surfactant; and, (H) a dye or other colorant.

Various embodiments of the invention include working compositions for direct use in treating metals, concentrates and partial concentrates from which such working compositions can be prepared by dilution with water and/or mixing with other chemically distinct concentrates, processes for treating metals with a composition according to the invention, and extended processes including additional steps that are conventional per se, such as rinsing, and, particularly advantageously, subsequent conversion coating and/or painting or some similar overcoating process that puts into place an organic binder containing protective coating over the metal surface treated according to a narrower embodiment of the invention. Articles of manufacture including surfaces treated according to a process of the invention are also within the scope of the invention.

At least the most preferred compositions and processes according to the invention meet the deoxidizing requirements of U.S. Military Specification MIL-W-6858C, ¶4.2.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: hexavalent chromium; silica; silicates that do not contain at least four atoms of fluorine per atom of silicon; ferricyanide; ferrocyanide; thiourea; pyrazole compounds; sugars; gluconic acid and its salts; glycerine; α-glucoheptanoic acid and its salts; and myoinositol phosphate esters and salts thereof. It is also preferred that the content of ferrous ions be no greater than 5, more preferably not greater than 3, or still more preferably not greater than 1.1, % of the content of ferric ions.

Furthermore, in a process according to the invention that includes other steps than the desmutting/deoxidizing treatment with a composition as described above, when avoidance of environmental pollution is an important consideration, it is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium. On the other hand, the desmutting/deoxidizing process taught herein can be advantageously used prior to chromate conversion coating or anodizing in a chromate containing—or, of course, a non chromate containing—solution, where one of the latter treatments is needed.

In an acidic aqueous composition to be used according to the invention, either directly as a working composition or as a source of active ingredients for making up a more dilute working composition, the concentration of nitric acid preferably is, with increasing preference in the order given, at least 0.1, 0.25, 0.5, 0.9, 1.3, 1.7, 2.0, 2.1, 2.2, 2.3, 2.4, 2.5, or 2.6 moles per liter of composition (hereinafter usually abbreviated "M"), and, if the composition is to be used for removing exceptionally heavy scale still more preferably is, with increasing preference in the order given, at least 2.8, 3.0, 3.2, 3.4, 3.6, 3.7, 3.8, or 3.9M. Independently, in a working composition the concentration of nitric add preferably is, with increasing preference in the order given, not greater than 10, 9, 8, 7.4, 6.8, 6.4, 6.2, 6.1, 6.0, or 5.9M, and for economy still more preferably is, with increasing preference in the order given, not more than 5.7, 5.5, 5.3, 5.1, 4.9, 4.7, 4.5, 4.3, 4.1, or 4.0M.

For ferric ions, the concentration in either a concentrated or a working composition preferably is, with increasing preference in the order given, at least 0.009, 0.02, 0.035, 0.05, 0.06, 0.07, 0.08, or 0.09M and, if a higher scale removal rate is desired, more preferably is, with increasing preference in the order given, at least 0.11, 0.13, 0.14, 0.15, 0.17, 0.19, 0.21, or 0.22, M; and independently this concentration in a working composition preferably is, with increasing preference in the order given, not greater than 1.0, 0.70, 0.62, 0.58, 0.50, 045, 0.37, or 0.30M or for maximum economy still more preferably is, with increasing preference in the order given, not more than 0.27, 0.25, 0.24, or 0.23M. Independently, the ratio of the molar concentration of ferric ions to the molar concentration of nitric acid in a working composition according to the invention preferably is, with increasing preference in the order given, not less than 0.003, 0.005, 0.007, 0.014, 0.018, 0.020, 0.024, 0.028, 0.032, 0.034, or 0.035 and independently preferably is, with increasing preference in the order given, not more than 0.4, 0.3, 0.2, 0.1, 0.08, 0.06, 0.055, 0.050, 0.045, 0.041, 0.038, or 0.036.

Because the degree of aggregation of molybdate ions is usually uncertain and is not believed to affect the favorable action of molybdate ions in compositions according to this invention, the concentration of these ions is described herein as the stoichiometric equivalent as molybdenum atoms, even though only those molybdenum atoms that are present in some form of molybdate or condensed molybdate anions are believed to be effective. In either a concentrated or a working composition according to the invention, this concentration preferably is, with increasing preference in the order given, at least 0.006, 0.011, 0.025, 0.031, 0.034, 0.037, 0.039, 0.040, 0.041, or 0.042M and for maximum desmutting activity still more preferably is, with increasing preference in the order given, at least 0.046, 0.051, 0.056, 0.060, 0.062, or 0.063M; and independently this concentration in a working composition preferably is not greater than 0.58, 0.41, 0.28, 0.20, 0.16, 0.12, 0.10, or 0.092M and for economy still more preferably is, with increasing preference in the order given, not greater than 0.087, 0.081, 0.077, 0.073, 0.070, 0.067, or 0.065M. Independently, the ratio of the molar concentration of molybdate ions to the molar concentration of nitric acid in a working composition according to this invention preferably is, with increasing preference in the order given, not less than 0.001, 0.002, 0.004, 0.007, 0.008, 0.009, 0.010, 0.011, 0.013, 0.015, or, 0.016 and independently preferably is, with increasing preference in the order given, not more than 0.16, 0.10, 0.07, 0.05, 0.03, 0.025, 0.021, 0.018, or 0.017. Also, independently, in either a working or a concentrate composition according to this invention, the ratio of the molar concentration of molybdate ions to the molar concentration of ferric ions preferably is, with increasing preference in the order given, at least 0.05, 0.088, 0.12, 0.15, 0.20, 0.25, 0.30, 0.35, 0.40, 0.42, 0.44, or 0.45 and independently preferably is, with increasing preference in the order given, not more than 4, 3, 2, 1, 0.8, 0.7, 0.6, 0.55, 0.50, 0.49, 0.48, or 0.47.

The presence of persulfate ions, optional component (D) as noted above, is preferred when very heavy layers of smut are to be removed with the compositions according to this invention, and/or when the surfaces to be treated with a composition according to this invention have been heavily shot peened with iron shot or otherwise caused to include embedded small particles of iron and then have been etched by a solution, such as a commonly used solution containing sodium sulfide, triethanol amine, and alkali, that can convert the iron particles to iron sulfide. For such applications, the oxidizing action of persulfate provides far more rapid desmutting and/or deoxidizing than compositions according to the invention from which persulfate is omitted. For these specialized applications, the concentration of persulfate in either a concentrated or a working composition, with increasing preference in the order given, preferably is at least 0.020, 0.042, 0.05 1, or 0.060, M; and, independently, this concentration in a working composition preferably is not greater than 0.19, 0.16, 0.10, 0.091, or 0.080M. Also, independently, in a working composition that contains persulfate, the ratio of the molar concentration of persulfate to the molar concentration of molybdate preferably is within the range from 0.4 to 1.5, more preferably from 0.6 to 1.2, or still more preferably from 0.80 to 0.95.

On the other hand, when the surfaces to be treated are covered with only average thicknesses of smut and/or oxide to be removed, and this smut and/or oxide is substantially free from iron and/or iron sulfide inclusions, persulfate is preferably omitted from compositions according to the invention for reasons of economy, because it is considerably more expensive than the other major components of the compositions.

Fluoride component (E) is preferred in most compositions according to the invention and is preferably supplied by soluble fluoride or bifluoride ions, more preferably the latter, which are counted as their stoichiometric equivalent as fluoride ions, as are hydrofluoric acid and any complex fluorometallic acids or their ions that may be present; the concentration as fluoride in either a working or concentrated composition, with increasing preference in the order given, preferably is at least 0.01, 0.028, 0.045, 0.055, 0.060, 0.065, 0.070, 0.074, or 0.078M and for maximum speed of desmutting and/or deoxidizing action still more preferably is, with increasing preference in the order given, at least 0.090, 0.097, 0.105, 0.110, 0.114, or 0.118M, and independently this concentration in a working composition preferably is, with increasing preference in the order given, not greater than 1.0, 0.7, 0.4, 0.28, 0.24, 0.22, 0.20, or 0.19M and for economy still more preferably is not greater than 0.16, 0.14, or 0.12M. While not being bound by theory, it is believed that the principal function of the fluoride ion content is to promote slight etching of the surface treated, so that the use of fluoride is particularly desirable when treating alloys, such as the 2000 and 7000 series of aluminum alloys, that contain relatively high percentages of elements that are electrochemically more noble than aluminum. When treating such alloys, an etching rate in the range from $1.3\times10^{-4}$ to $6.4\times10^{-4}$ centimeters of depth per hour from exposed surfaces of the alloys is preferred during a desmutting and/or deoxidizing process according to this invention. Such an etching rate will generally be achieved with the preferred amounts of fluoride ions noted above, but if it is not, the fluoride concentration should preferably be adjusted so as to achieve this desired etch rate. With other alloys that are recognized in the art as more easily desmutted, fluoride ions may be reduced or even omitted altogether, as indicated by their description as an optional component above.

The presence of sulfate ions, optional component (F), is generally preferred in compositions according to the invention. The concentration of sulfate ions, including the stoichiometric equivalent as sulfate ions of any sulfuric acid present, in either a working or a concentrated composition preferably is, with increasing preference in the order given, at least 0.03, 0.06, 0.09, 0.20, 0.24, 0.28, 0.30, 0.32, or 0.34M and for a faster desmutting and/or deoxidizing rate still more preferably is, with increasing preference in the order given, at least 0.38, 0.42, 0.46, 0.49, or 0.51M, and in a working composition this concentration independently preferably is, with increasing preference in the order given, not greater than 5, 2.5, 1.9, 1.6, 1.2, 0.91, 0.85, or 0.79M and for economy still more preferably is, with increasing preference in the order given, not more than 0.70, 0.65, 0.62, 0.60, 0.58, 0.56, 0.54, or 0.53M. Generally, to avoid other materials that might have unwanted effects on performance, it is preferred that the sulfate content of compositions according to this invention be derived from ferric sulfate and sulfuric acid. Also, independently, the ratio of the molar concentration of sulfate ions to the molar concentration of nitric acid in a working composition according to the invention preferably is, with increasing preference in the order given, at least 0.01, 0.02, 0.04, 0.06, 0.08, 0.10, 0.11, 0.12, or 0.13 and independently preferably is, with increasing preference in the order given, not more than 1.2, 1.0, 0.8, 0.6, 0.4, 0.30, 0.25, 0.21, 0.18, 0.16, or 0.14.

For component (G), almost any surfactant that is effective to lower the surface tension and solubilize any organic contaminants present on the surface to be treated could be used in principle, but most kinds of surfactants are unstable in the highly oxidizing acidic composition. No surfactant with stability for more than a few months at best has been found; the best known ones are described in the above noted U.S. Application Ser. No. 08/088,998, now Pat. No. 5,393,447 the pertinent part of which is hereby incorporated herein by reference, and in the examples below. Particularly if persulfate is not included in the composition, no surfactant at all is generally needed.

Component (H) is not believed to serve any technical purpose in the composition, but it is often valued as a safety precaution to workers to indicate the presence of strong acids by a prominent color such as red. An amount of dye or other colorant sufficient to be readily recognized by workers, without being so large as to impose a significant economic cost or adversely impact the intended technical functions of the composition, can be readily chosen by those skilled in the art.

In addition to the other characteristics noted above, a working composition according to the invention preferably has, with increasing preference in the order given, at least 2, 4, 6, 8, 10, 12, 14, or 15 "points" of total acid, such points being defined for this purpose as equal to the number of milliliters (hereinafter usually abbreviated "mL") of 1.0N strong alkali (such as sodium hydroxide) required to titrate a 5.0 mL sample of the composition, after the sample is diluted with at least about 10 mL of deionized water containing a large excess of potassium fluoride to prevent precipitation of any heavy metal hydroxides during titration, to an end point with phenolphthalein indicator. For the highest desmutting/deoxidizing rate, a working composition still more preferably has, with increasing preference in the order given, at least 18, 20, 21, 22, or 22.5 points of total acid as thus defined. Independently, a working composition according to this invention preferably has, with increasing preference in the order given, no more than 60, 50, 45, 35, 32, or 31 points of total acid, or for economy still more preferably not more than 29, 27, 26, 25, or 24 points of total acid. Also and independently, a persulfate containing working composition according to the invention preferably has an oxidation-reduction "redox") potential, measured by comparing the potential of a platinum electrode immersed in the composition against a standard saturated calomel electrode immersed in the same composition, within the range of, with increasing preference in the order given, from 800 to 1100, from 900 to 1050, from 950 to 1035, from 975 to 1029, from 985 to 1020, from 991 to 1011, or from 996 to 1006, millivolts (hereinafter sometimes abbreviated "mv") more oxidizing than the standard electrode.

A working composition according to the invention may be applied to a metal surface to be treated by any convenient method, several of which will be readily apparent to those skilled in the art. Immersion is the simplest and is believed most often used. However, spraying, roll coating, and the like can also be used.

The temperature during contact and time of contact between the composition according to the invention and the metal to be treated thereby may be varied within wide limits to achieve the desired effects, which can often be determined by visual inspection of the metal surface, after rinsing if necessary. As a general guideline, the temperature normally preferably is, with increasing preference in the order given, not less than 5°, 10°, 15°, 17°, 19°, 20°, 21°, 22°, or 23° C. and independently preferably is, with increasing preference in the order given, not more than 80°, 60°, 50°, 40°, 35°, 34°, 33°, 32°, 31°, 30°, 29°, 28°, 27°, or 26, °C., and the time of contact normally preferably is, with increasing preference in the order given, not less than 0.1, 0.5, 1.0, 1.5, 1.8, or 2.0 minutes and independently preferably is, with increasing preference in the order given, not more than 30, 20, 15, 10, 8, 7, 6, 5.5, or 5.0 minutes.

After treatment according to this invention, the treated surfaces are normally rinsed with water before any subsequent treatment. Particularly if the composition contains persulfate, the rinsing preferably is completed as soon as practical after removing the treated surfaces from contact with the desmutting/deoxidizing composition, and if at all practicable should at least be completed before the desmutting/deoxidizing composition has dried into place on any part of the surface-otherwise the surface may become stained. After rinsing the surfaces often are also dried. Rinsing, drying, and any subsequent treatments are generally performed in a manner known per se in the art.

The invention is particularly advantageously adapted to the treatment of aluminum alloys 7150, 7075, 2024, 2324, and 6061; also to any aluminum or magnesium alloy surfaces that have been heavily shot peened or otherwise mechanically worked, and/or have been chemically milled or heavily chemically etched with alkaline compositions, before treatment according to the invention.

If it is desired to supply a concentrate from which the working composition can be prepared by dilution with water, the primary concentrate preferably does not contain any persulfate component, which has been observed to be unstable in long term storage when mixed with the other components of a composition according to this invention. Also, the nitric acid and any surfactants desired are preferably supplied separately. A preferred primary concentrate according to the invention therefore contains only sulfate, ferric ion, fluoride, and molybdate components, and optionally, dye or colorant, in addition to water. In one particularly preferred concentrate embodiment, the following components and concentrations are preferred, each independently except for the additional preferences for ratios already given above, and with increasing preference in the order given for each series of numbers: at least 2.2, 3.0, 4.4, 5.5, 6.6, 7.7, 8.8, 9.9, 11.0, 11.5, 12.0, 12.5, 13.0, 13.5, 13.8, 14.0, 14.2, or 14.3% but not more than 45, 35, 25, 18, 17, 16, 15.5, 15.0, 14.8, 14.6, or 14.5% of sulfuric acid; at least 1.7, 3.5, 4.5, 5.5, 6.5, 7.5, 8.5, 9.0, 9.5, 10.0, 10.2, 10.4, or 10.5% but not more than 30, 25, 20, 18, 16, 14, 12, 11.5, 11.0, or 10.8% of ferric sulfate (anhydrous equivalent); at least 0.8, 1.6, 2.6, 3.1, 3.6, 4.1, 4.4, 4.6, 4.8, or 4.9% but not more than 15, 12, 10, 8, 7, 6.5, 6.0, 5.7, 5.4, 5.2, or 5.1% of ammonium dimolybdate, i.e., $(NH_4)_2\ Mo_2O_7$; and at least 0.25, 0.50, 0.75, 1.0, 1.2, 1.3, 1.4, 1.5, or 1.55% but not more than 4.8, 4.0, 3.5, 3.0, 2.5, 2.0, 1.8, 1.7, or 1.6% of ammonium acid fluoride. The balance not specified above is water.

During extended use of a composition according to this invention, new constituents may be introduced into the composition by dissolution of the metal objects treated, and some of the constituents of the bath may be consumed by reaction. Therefore, as with other similar treatments, if very long term operation is desired, it is advantageous to withdraw a portion of the composition continuously for removal of any unwanted constituents and to replenish depleted desirable constituents. In some cases, only replenishment may be satisfactory, or no treatment of the composition at all may be required. Normally, however, the accumulation of aluminum, copper, and/or zinc cations in working compositions according to the invention is deleterious to the desired performance of the compositions.

The practice of this invention may be further appreciated by consideration of the following, non-limiting, working examples.

EXAMPLES

Working Composition Including Persulfate

One preferred working composition contains:

(A) 4.04M $HNO_3$ (provided by commercial concentrated nitric acid of 42° Baumè);

(B) 0.13M $Fe_2(SO_4)_3$ (provided by a commercially available 50% aqueous solution);

(C) 0.059M $(NH_4)_2Mo_2O_7$ (provided from commercial solid salt);

(D) 0.0701M $(NH_4)_2S_2O_8$ (provided from commercial solid salt);

(E) 0.056M $NH_4HF_2$ (provided from commercial solid salt);

(F) 0.354M $H_2SO_4$ (provided from commercial concentrated sulfuric acid);

(G) 0.51 g/L of each of SURFYNOL™ 465 and 440 surfactants, commercially available from Air Products Co and described by the supplier as ethoxylated tetramethyl decynediols, the former with an HLB value of 13.0 and the latter with an HLB value of 8.0; and (H) 0.18 g/L of NYLOSAN™ RHODAMINE™ E-B 90 red dye. (Note: The total concentration of ferric ions in this composition is 0.26M, because there are two ferric ions in each mole of ferric sulfate salt; the total concentration of fluoride ions is 0.112M, because there are two fluorine atoms in each mole of ammonium bifluoride, and the total concentration of sulfate ions is 0.74M, including 0.39M supplied by the ferric sulfate along with the 0.35M supplied by the sulfuric acid.)

This composition had a redox potential of 1001 mv and 24 free acid points.

Use of a Persulfate Containing Composition According to the Invention

Panels of Type 7150 aluminum, each panel containing at least one hole in order to make a more critical evaluation of the staining and/or smutting tendency, which is usually more pronounced in recesses and holes in parts being treated under practical conditions, were pre-etched to produce a reproducible oxidized and smutted surface by immersion for 7 to 10 minutes ("min") at a temperature within the range from 29.4° to 32.2° C. in an alkaline etching solution consisting of water and 120–150 g/L of sodium hydroxide, 11–26 g/L of sodium sulfide, 30–60 g/L of triethanol amine, and 18–50 g/L of dissolved aluminum.

After removal from the etching solution, the etched panels were allowed to stand in ambient air for 2–3 min, then successively rinsed twice for 2–3 minutes each time with deionized water at ambient temperature, then immersed in the above noted desmutting composition for 10 min at ambient temperature with air agitation of the composition, allowed to stand in the ambient air for 2–3 min, then rinsed twice, the first time for 2–3 min and the second time for 1 min, with deionized water. Some of the panels were then conventionally anodized with satisfactory results. Others of the panels were allowed to dry and visually examined. Bright, smooth surfaces without smut were produced.

Concentrate Partial Composition for a Working Composition to Contain Persulfate A preferred concentrate partial composition consists of 150 parts of sulfuric acid, 50 parts of ammonium dimolybdate, 250 parts of ferric sulfate, 16 parts of ammonium bifluoride, with the balance to 1000 parts being water. This concentrate can be used, together with separate sources of nitric acid and persulfate, to make the working composition shown above.

Concentrate Partial Composition for a Persulfate Free Working Composition

A preferred concentrate of this type consists of 10.7% of $Fe_2(SO_4)_3$, 5% of $(NH_4)_2Mo_2O_7$, 14.7% $H_2SO_4$, 1.6% of $NH_4F{\cdot}HF$, and the balance water. From 10 to 20 volume % of this concentrate, combined with from 20 to 30 volume % of 66° Baumè nitric acid in water solution, forms a highly effective general purpose desmutter/deoxidizer for aluminum, magnesium, and their alloys. These working compositions can be made up with hard tap water without loss of performance and can contain up to 1000 ppm of copper and 1600 ppm of zinc without staining the treated surfaces.

What is claimed is:

1. A liquid desmutting/deoxidizing composition of matter consisting essentially of water and:

(A) nitric acid;

(B) ferric ions; and (C) a component selected from the group consisting of molybdate and condensed molybdate anions, said composition not containing persulfate anions.

2. A desmutting/deoxidizing composition according to claim 1, wherein nitric acid is present at a concentration within the range from about 0.9 to about 8M , ferric ions are present at a concentration within the range from about 0.02 to about 1.0M, component (C) is present at a concentration stoichiometrically equivalent to a concentration of molybdenum atoms within the range from about 0.006 to about 0.58M, and further comprising a component (E) which is selected from the group consisting of fluorine containing anions is present at a concentration stoichiometrically, equivalent to a concentration of fluorine atoms within the range from about 0.028 to about 1.0M, and a component (F) selected from the group consisting of sulfuric acid, sulfate ions, and hydrogen sulfate ions present at a concentrate within a range from about 0.06 to about 5M.

3. A desmutting/deoxidizing composition according to claim 2, wherein: the molar concentration of ferric ions has a ratio to the molar concentration of nitric acid that is in the range from about 0.014 to about 0.1; the molar concentration of the stoichiometric equivalent as molybdenum atoms from component (C) has a ratio to the molar concentration of nitric acid that is in the range from about 0.15 to about 1; and the molar concentration of component (F) has a ratio to the molar concentration of nitric acid that is in the range from about 0.06 to about 0.4.

4. A desmutting/deoxidizing composition according to claim 2, wherein: the ratio of the molar concentration of ferric ions to the molar concentration of nitric acid is in the range from about 0.024 to about 0.050; the ratio of the molar concentration of the stoichiometric equivalent as molybdenum atoms from component (C) to the molar concentration of nitric acid is in the range from about 0.30 to about 0.7; and the ratio of the molar concentration of component (F) to the molar concentration of nitric acid is in the range from about 0.10 to about 0.25.

5. A desmutting/deoxidizing composition according to claim 4, wherein the concentration of nitric acid is within the range from about 1.7 to about 7.4M, the concentration of ferric ions is within the range from about 0.05 to about 0.45M, the concentration of component (C) is stoichiometrically equivalent to a concentration of molybdenum atoms within the range from about 0.031 to about 0.28M, the concentration of component (E) is stoichiometrically equivalent to a concentration of fluorine atoms within the range from about 0.055 to about 0.4M, and the concentration of component (F) is within the range from about 0.24 to about 1.6M.

6. A desmutting/deoxidizing composition according to claim 5, wherein the concentration of nitric acid is within the range from about 2.2 to about 6.4M, the concentration of ferric ions is within the range from about 0.07 to about 0.37M, the concentration of component (C) is stoichiometrically equivalent to a concentration of molybdenum atoms within the range from about 0.037 to about 0.12M, the concentration of component (E) is stoichiometrically equivalent to a concentration of fluorine atoms within the range from about 0.065 to about 0.24M, and the concentration of component (F) is within the range from about 0.30 to about 1.2M.

7. A desmutting/deoxidizing composition according to claim 6, wherein the concentration of nitric acid is within the range from about 2.6 to about 5.9M, the concentration of ferric ions is within the range from about 0.09 to about 0.30M, the concentration of component (C) is stoichiometrically equivalent to a concentration of molybdenum atoms within the range from about 0.042 to about 0.092M, the concentration of component (E) is stoichiometrically equivalent to a concentration of fluorine atoms within the range from about 0.078 to about 0.19M, the concentration of component (F) is within the range from about 0.34 to about 0.79M, and the composition has a total acid content that is from about 15 to about 31 points.

8. A desmutting/deoxidizing composition according to claim 7, wherein the concentration of nitric acid is within the range from about 3.8 to about 4.1M, the concentration of ferric ions is within the range from about 0.21 to about 0.24M, the concentration of component (C) is stoichiometrically equivalent to a concentration of molybdenum atoms within the range from about 0.062 to about 0.067M, the concentration of component (E) is stoichiometrically equivalent to a concentration of fluorine atoms within the range from about 0.114 to about 0.14M, and the concentration of component (F) is within the range from about 0.49 to about 0.53M.

9. A process of contacting a smutted or oxidized metal surface of Type 7150, 7075, 2324, 2024, or 6061 aluminum alloy with a composition according to claim 8 at a temperature within the range from about 20° to about 26° C. for a time within the range from about 2 to about 5 minutes and subsequently removing the surface from contact with said composition and rinsing the removed surface with water, so as to produce a bright surface.

10. A process of contacting a smutted or oxidized metal surface of magnesium, aluminum, an alloy of aluminum with at least 45% of aluminum, or an alloy of magnesium with at least 45% of magnesium with a composition according to claim 7 at a temperature within the range from about 17° to about 30° C. for a time within the range from about 2 to about 20 minutes and subsequently removing the surface from contact with said composition and rinsing the removed surface with water, so as to produce a bright surface.

11. A process of contacting a smutted or oxidized metal surface with a composition according to claim 6 at a temperature within the range from about 15° to about 35° C. for a time within the range from about 0.5 to about 30 minutes and subsequently removing the surface from contact with said composition and rinsing the removed surface with water, so as to produce a bright surface.

12. A process of contacting a smutted or oxidized metal surface with a composition according to claim 5 at a temperature within the range from about 15° to about 35° C. for a time within the range from about 0.5 to about 30 minutes and subsequently removing the surface from contact with said composition and rinsing the removed surface with water, so as to produce a bright surface.

13. A process of contacting a smutted or oxidized metal surface with a composition according to claim 4 at a temperature within the range from about 15° to about 35° C. for a time within the range from about 0.5 to about 30 minutes and subsequently removing the surface from contact with said composition and rinsing the removed surface with water, so as to produce a bright surface.

14. A process of contacting a smutted or oxidized metal surface with a composition according to claim 3 at a temperature within the range from about 15° to about 35° C. for a time within the range from about 0.5 to about 30 minutes and subsequently removing the surface from contact with said composition and rinsing the removed surface with water, so as to produce a bright surface.

15. A process of contacting a smutted or oxidized metal surface with a composition according to claim 2 at a temperature within the range from about 15° to about 35° C. for a time within the range from about 0.5 to about 30 minutes and subsequently removing the surface from contact with said composition and rinsing the removed surface with water, so as to produce a bright surface.

16. A process of contacting a smutted or oxidized metal surface with a composition according to claim 1 for a sufficient time to remove at least part of the smut or oxide from the surface.

17. A liquid concentrate composition of matter, consisting essentially of water and:

(A) nitric acid;

(B) ferric ions;

(C) a component selected from the group consisting of molybdate and condensed molybdate anions, (E) a component selected from the group consisting of fluorine containing anions; and (F) a component selected from sulfuric acid, sulfate ions, and hydrogen sulfate ions; said composition not containing persulfate anions.

18. A concentrate composition according to claim 17, consisting essentially of water and from about 4.4 to about 18% of sulfuric acid, about 6.5 to about 25% of ferric sulfate, about 2.6 to about 6.5% of ammonium dimolybdate, and about 1.0 to about 4.0% of ammonium acid fluoride, wherein the molar concentration of molybdenum atoms from component (C) has a ratio to the molar concentration of ferric ions that is from about 0.25 to about 0.55.

19. A concentrate composition according to claim 18, consisting essentially of water and from about 9.9 to about 17% of sulfuric acid, about 6.5 to about 12% of ferric sulfate, about 3.6 to about 6.0% of ammonium dimolybdate, and about 1.3 to about 3.0% of ammonium acid fluoride.

20. A concentrate composition according to claim 19, consisting essentially of water and from about 14.0 to about 15.0% of sulfuric acid, about 10.0 to about 11.0% of ferric sulfate, about 4.4 to about 5.4% of ammonium dimolybdate, and about 1.4 to about 2.0% of ammonium acid fluoride.

* * * * *